US008465267B2

(12) United States Patent
Hansen et al.

(10) Patent No.: US 8,465,267 B2
(45) Date of Patent: Jun. 18, 2013

(54) POWER CONNECTORS FOR PUMP ASSEMBLIES

(75) Inventors: Kim Hoerdum Hansen, Viborg (DK); Jason Carman, Gardner, KS (US); Ryan Haack, Lawrence, KS (US)

(73) Assignee: Grundfos Pumps Corporation, Olathe, KS (US)

( * ) Notice: Subject to any disclaimer, the term of this patent is extended or adjusted under 35 U.S.C. 154(b) by 336 days.

(21) Appl. No.: 12/795,480

(22) Filed: Jun. 7, 2010

(65) Prior Publication Data

US 2010/0247352 A1 Sep. 30, 2010

Related U.S. Application Data

(63) Continuation-in-part of application No. 12/358,837, filed on Jan. 23, 2009.

(51) Int. Cl.
*F04D 29/60* (2006.01)
*H01R 27/00* (2006.01)

(52) U.S. Cl.
USPC ..... 417/423.14; 310/71; 439/218

(58) Field of Classification Search
USPC ..... 310/71; 417/411, 423.1, 374, 423.14; 307/134, 147; 439/502, 535, 660, 626, 577, 439/533, 76.2, 218, 221, 217, 855, 857, 856
See application file for complete search history.

(56) References Cited

U.S. PATENT DOCUMENTS

| | | | | | |
|---|---|---|---|---|---|
| 2,383,926 | A | * | 8/1945 | White | 439/589 |
| 3,440,592 | A | * | 4/1969 | Zelle | 439/108 |
| 4,319,299 | A | * | 3/1982 | Woods et al. | 361/24 |
| 4,742,210 | A | * | 5/1988 | Tsuchiyama et al. | 219/541 |
| 4,782,244 | A | * | 11/1988 | Wakimoto | 307/116 |
| 4,851,725 | A | * | 7/1989 | Keck | 310/71 |
| 4,945,491 | A | | 7/1990 | Rishel | |
| 5,015,894 | A | * | 5/1991 | Crow et al. | 310/71 |
| 5,126,608 | A | * | 6/1992 | Sogabe et al. | 310/71 |
| 5,199,898 | A | * | 4/1993 | Wisner | 439/367 |
| 5,665,939 | A | * | 9/1997 | Jorgensen et al. | 174/50.52 |
| 5,764,148 | A | | 6/1998 | Frasier | |
| 5,861,689 | A | * | 1/1999 | Snider et al. | 310/71 |

(Continued)

FOREIGN PATENT DOCUMENTS

| | | | |
|---|---|---|---|
| JP | 58045514 | A2 | 3/1983 |
| JP | 02136584 | A2 | 5/1990 |
| JP | 05223318 | A2 | 8/1993 |
| WO | WO 2007052786 | A1 * | 5/2007 |

*Primary Examiner* — Devon Kramer
*Assistant Examiner* — Nathan Zollinger
(74) *Attorney, Agent, or Firm* — The Small Patent Law Group, LLC

(57) ABSTRACT

A pump assembly includes a pump housing, a motor coupled to the pump housing being operated to drive fluid through the pump housing, and a control module operatively coupled to the motor. The control module has a power connector with power contacts, where the power connector has a plug interface. The pump assembly also includes first and second plug assemblies configured to be selectively coupled to the power connector. The first and second plug assemblies have first and second mating interfaces both configured to mate with the plug interface of the power connector. The first plug assembly includes a line cord having a pump plug at one end of the line cord and an outlet plug at an opposite end of the line cord. The second plug assembly includes a conduit box having plug contacts configured to be field wired to a power cable within the conduit box.

27 Claims, 14 Drawing Sheets

U.S. PATENT DOCUMENTS 5,885,102 A * 3/1999 Harting et al. ..... 439/527
6,102,666 A * 8/2000 Albrecht ..... 417/32
6,137,416 A 10/2000 Meador
6,290,528 B1 * 9/2001 Moore et al. ..... 439/367
6,424,105 B1 7/2002 Breit et al.
6,464,464 B2 10/2002 Sabini et al.
6,651,900 B1 11/2003 Yoshida
2006/0045750 A1 3/2006 Stiles
2007/0114162 A1 5/2007 Stiles et al.
2007/0154323 A1 7/2007 Stiles, Jr. et al.
2009/0260382 A1 * 10/2009 Takeichi et al. ..... 62/259.1

* cited by examiner

POWER CONNECTORS FOR PUMP ASSEMBLIES

CROSS REFERENCE TO RELATED APPLICATIONS

This application is a continuation-in-part application, and claims the benefit of, U.S. patent application Ser. No. 12/358,837, titled PUMP ASSEMBLY HAVING AN INTEGRATED USER INTERFACE filed Jan. 23, 2009, the subject matter of which is herein incorporated by reference in its entirety.

BACKGROUND OF THE INVENTION

The subject matter herein relates generally to pump assemblies, and more particularly to power connectors for pump assemblies.

Pumps typically include a pump housing, which is connected to a piping system, and a motor for driving an impeller within the pump housing to pump fluid through the pump housing. The impeller is typically mounted to an end of a rotor shaft and is driven by the motor to move fluid through the pump. The motors are connected to a power source which powers the motor. Some pumps, in particular in the form of heating circulation pumps, often include electrical drive motors which are designed as permanent magnet motors. The permanent magnet motors include a rotor which is equipped with permanent magnets and which is set into rotation by way of subjecting corresponding stator coils to current. Known rotors typically have a central rotor shaft which is rotatably mounted on bearings, such as sliding bearings, mounted in a stator housing or on the stator. The permanent magnets are fixed on the rotor shaft, which drive the rotor shaft. Permanent magnet motor pumps typically have a high-efficiency as compared to other types of pumps. As such, permanent magnet motor pumps have lower power consumption for moving fluid as compared other centrifugal pumps. Permanent magnet motor pumps operate quietly, and thus are desirable for certain applications, such as use in homes.

One particular application that typically uses permanent magnet motor pumps, is a hydronic heating or cooling system, wherein the pump supplies fluid to different zones or circuits. A problem with such systems is that it may be difficult to determine an efficiency or other operating characteristics of the pump because the system is a closed system. It is difficult to determine how often or at what capacity the pump is operating at any given time. One solution to such problems is to provide sensors within the system to monitor operating characteristics of the pump or the system overall. Examples of separate sensors that may be provided within the system include flow sensors, pressure sensors, power consumption monitors, and the like. However, adding such sensors increases the overall cost and complexity of the system. Additionally, the sensors typically operate independently of the pump and may be located remotely with respect to the pump.

Furthermore, another problem with known pumps, including permanent magnet motor pumps, is that the pumps require an electrical connection. Typically a pump is provided with one type of electrical connection, which may not be the desired type of electrical connection in the particular application for the pump. For example, in some situations, an electrical outlet may be provided in the vicinity of the pump, and it may be desirable to connect the pump to the electrical outlet using a line cord having an outlet plug at an end of the line cord. However, in other situations, no electrical outlets may be provided in the vicinity of the pump, and thus it may be desirable to connect the pump to a power cable routed from a central building junction box. Pump selection may be made based on the type of electrical connection in the particular application. Some pump suppliers only offer one or the other type of electrical connection, and thus may lose potential sales. Additionally, it may be more costly to a supplier to carry two identically operating pumps having different types of electrical connections.

A need remains for a pump that may be operated in a cost effective and reliable manner. A need remains for a pump having different types of electrical connections available.

BRIEF DESCRIPTION OF THE INVENTION

In one embodiment, a pump assembly is provided that includes a pump housing, a motor coupled to the pump housing being operated to drive fluid through the pump housing, and a control module operatively coupled to the motor. The control module has a power connector with power contacts, where the power connector has a plug interface. The pump assembly also includes first and second plug assemblies configured to be selectively coupled to the power connector. The first and second plug assemblies have first and second mating interfaces both configured to mate with the plug interface of the power connector. The first plug assembly includes a line cord having a pump plug at one end of the line cord and an outlet plug at an opposite end of the line cord. The second plug assembly includes a conduit box having plug contacts configured to be field wired to a power cable within the conduit box.

In another embodiment, a pump assembly is provided including a pump housing, a motor coupled to the pump housing being operated to drive fluid through the pump housing, and a control module operatively coupled to the motor. The control module has a power connector with power contacts, where the power connector has a plug interface. The pump assembly also includes a plug assembly removably coupled to the power connector that has a conduit box with a mating interface configured to mate with the plug interface of the power connector. The conduit box includes a contact subassembly holding plug contacts that are mated with corresponding power contacts. The plug contacts are configured to be terminated to individual wires of a cable within the conduit box.

In a further embodiment, a method of assembling a pump is provided including providing a first plug assembly having a line cord with a pump plug at one end of the line cord and an outlet plug at an opposite end of the line cord with the pump plug having plug contacts. The method also includes providing a second plug assembly having a conduit box with a contact subassembly holding plug contacts being configured to be terminated to individual wires of a cable within the conduit box. The method also includes selecting either the first plug assembly or the second plug assembly, and coupling the selected plug assembly to a power connector of a pump. The power connector has power contacts mated to the plug contacts of the selected plug assembly.

DETAILED DESCRIPTION OF THE INVENTION

Figure 1:
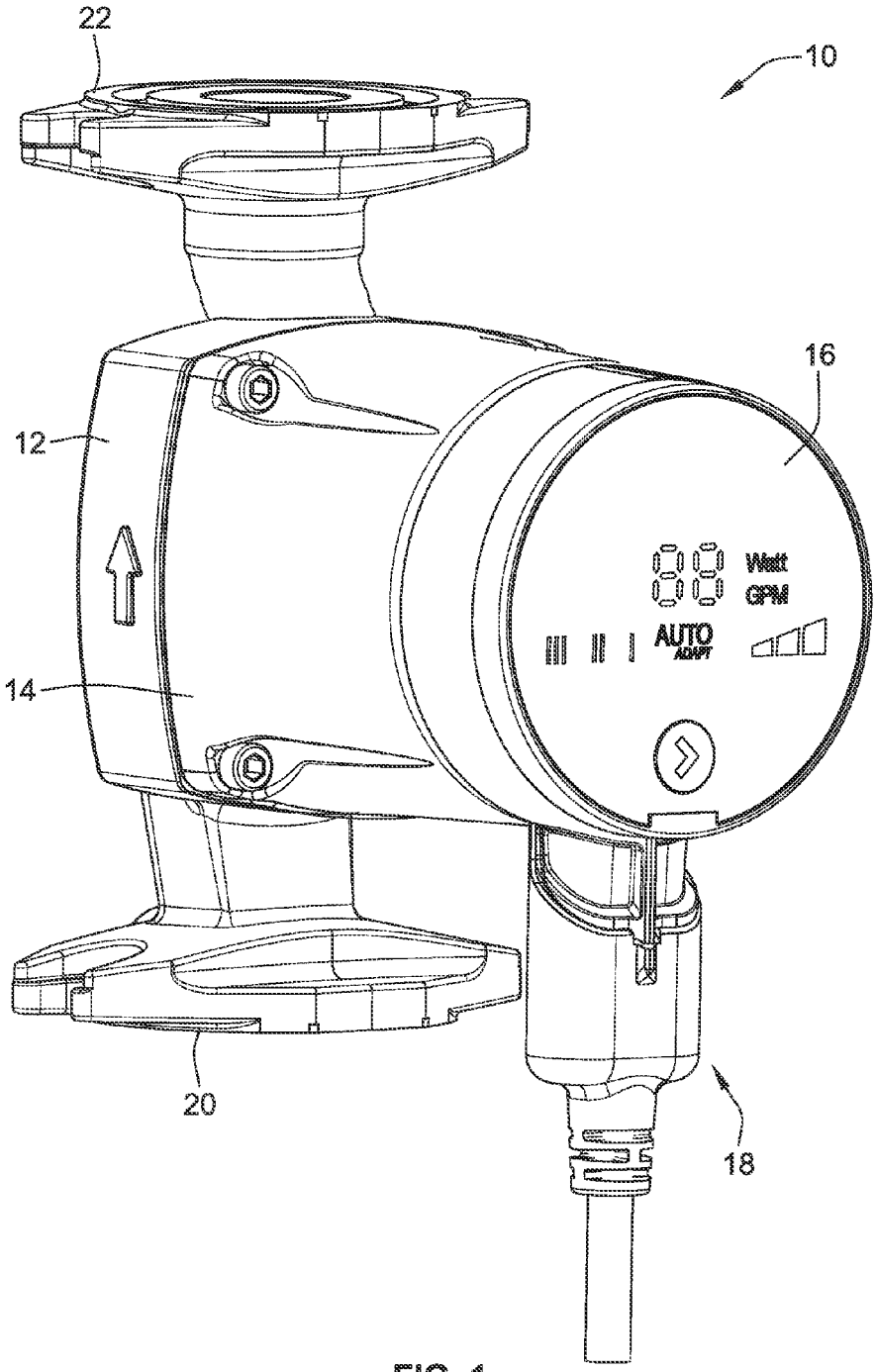
FIG. 1 illustrates a pump assembly in accordance with an exemplary embodiment.

FIG. 1 illustrates a pump assembly 10 in accordance with an exemplary embodiment. The pump assembly 10 includes a pump housing 12, a motor 14 attached to the pump housing 12, and a control module 16 attached to the motor 14. The control module 16 operates the motor 14 to move fluid through the pump housing 12. The motor 14 is an electrical motor that is driven by a power source connected to the control module 16 by a plug assembly 18. In an exemplary embodiment, the motor 14 is a permanent magnet motor.

The pump housing 12 includes a suction end 20 and a discharge end 22. The suction end 20 may be coupled to a supply pipe (not shown) and the discharge end 22 may be coupled to a discharge pipe (not shown). Fluid is supplied to the pump housing 12 by the supply pipe and the fluid is moved to the discharge pipe by the pump assembly 10. Different flow characteristics, such as the amount of flow, the flow rate, the pressure of the fluid, the temperature of the fluid, the amount of heat energy used by the system and the like may be controlled by the control module 16 operating the motor 14 according to various operating parameters.

Figure 2:
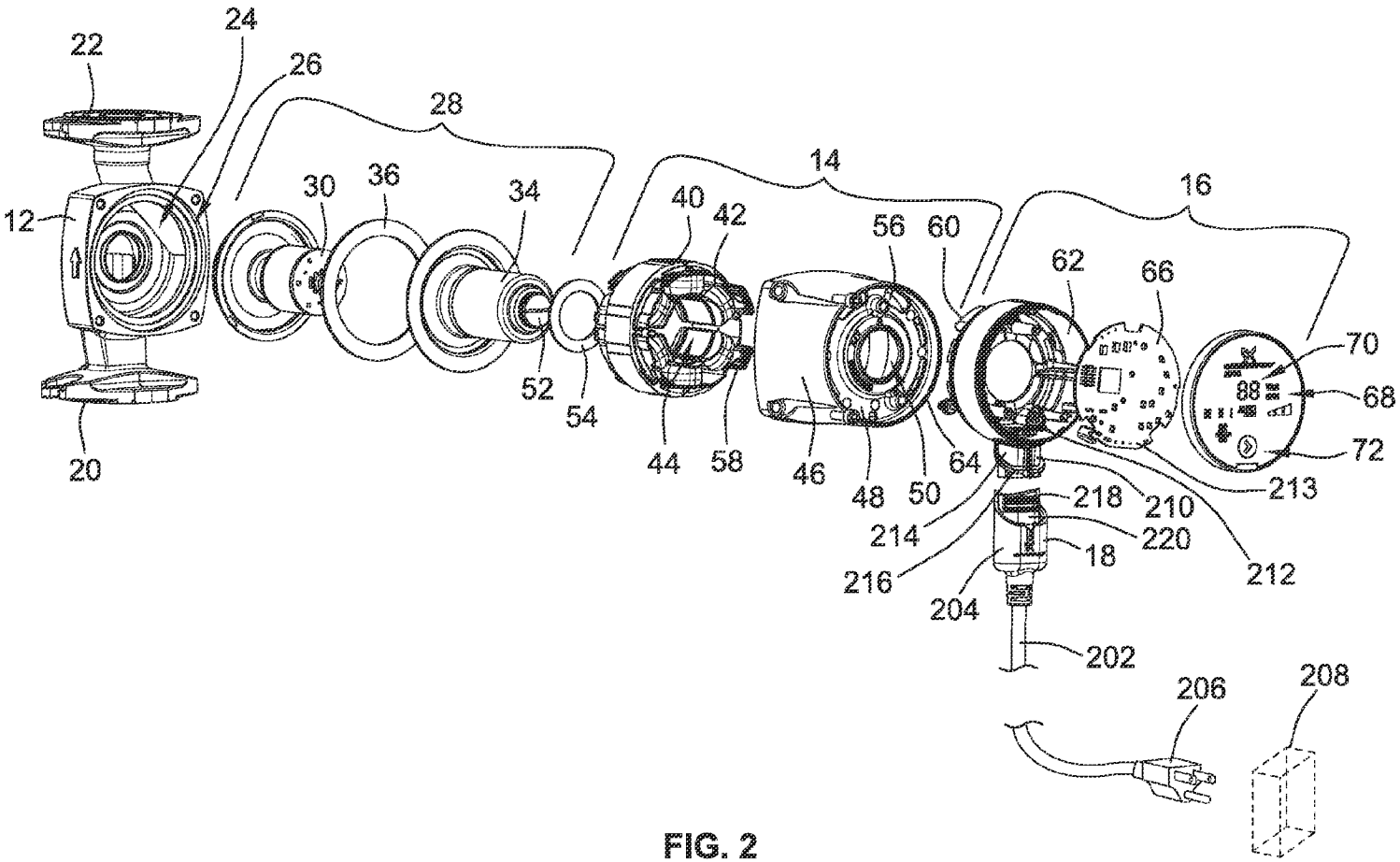
FIG. 2 is a front exploded view of the pump assembly shown in FIG. 1.
Figure 3:
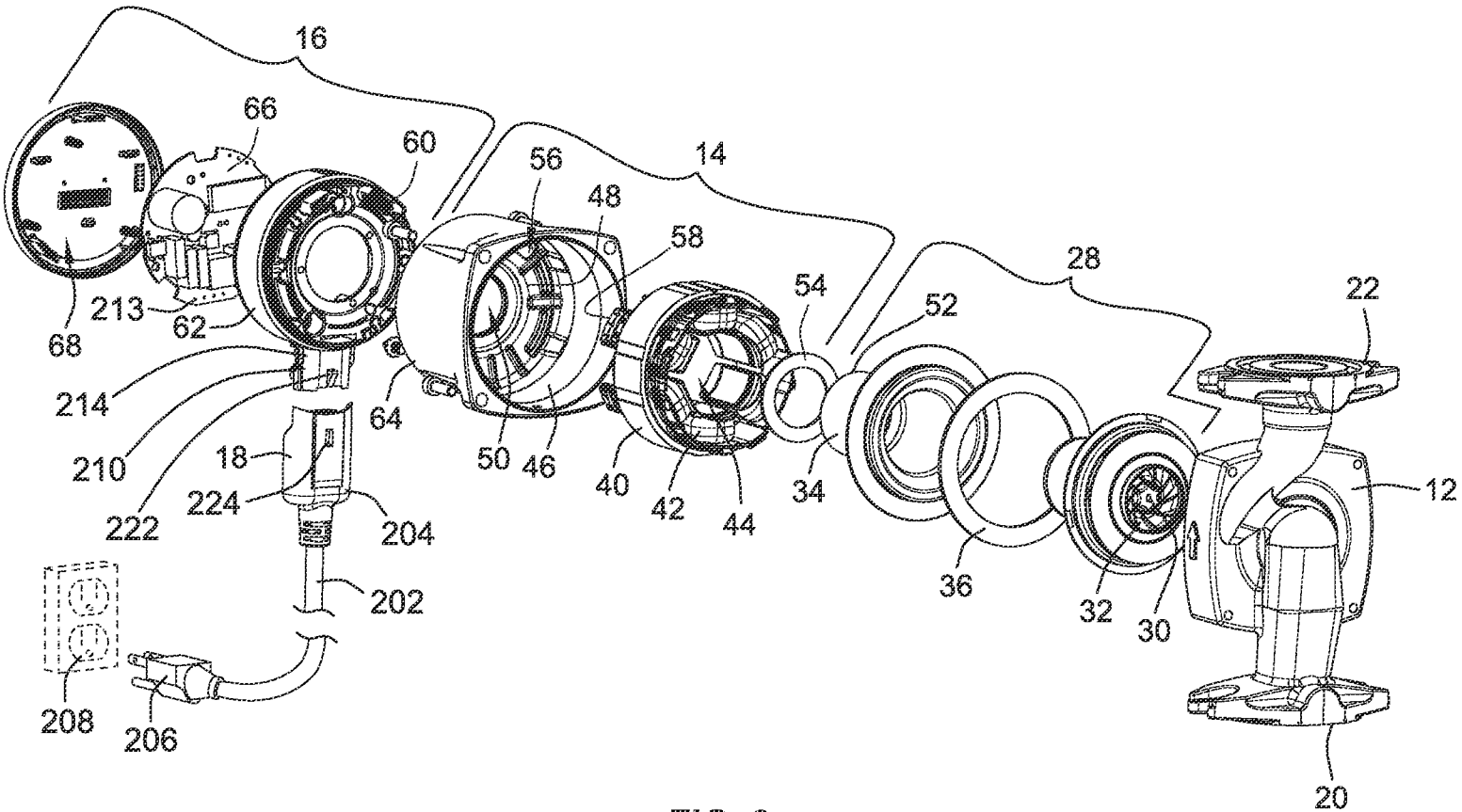
FIG. 3 is a rear exploded view of the pump assembly shown in FIG. 1.

FIGS. 2 and 3 are front and rear exploded views of the pump assembly 10 illustrating the pump housing 12, the motor 14 and the control module 16. The pump housing 12 includes a chamber 24 extending between the suction and discharge ends 20, 22. The chamber 24 channels the fluid between the ends 20, 22. The pump housing 12 has an opening 26 that receives a rotor assembly 28 therein. The opening 26 opens to the chamber 24.

The rotor assembly 28 includes a rotor shaft 30 and at least one impeller 32 mounted to the rotor shaft 30. The impeller 32 is in fluid communication with the fluid in the pump housing 12. The rotor shaft 30 is rotated to move the impeller 32 and thus move the fluid through the pump housing 12. The rotor assembly 28 includes a rotor can 34. The rotor shaft 30 is at least partially received in the rotor can 34. Optionally, one or more gaskets 36 may be provided between the rotor assembly 28 and the pump housing 12 to provide a fluid seal.

In an exemplary embodiment, the motor 14 is a permanent magnet motor, and includes a stator 40 having a plurality of coil windings 42. The stator 40 has a central bore 44 that receives a portion of the rotor assembly 28. The coil windings 42 are positioned around a central bore 44. Power or current is supplied to the coil windings 42 to create a stator field. The stator field acts on the rotor assembly 28 to drive the rotor shaft 30. The power supplied to the coil windings 42 may be controlled to control the rotational speed of the rotor shaft 30, and thus the impeller 32.

The motor 14 includes a stator housing 46 that may be coupled to the pump housing 12. The stator 40 is received in the stator housing 46. A portion of the rotor assembly 28 may also be positioned in the stator housing 46. The stator housing 46 includes a wall 48 having a central opening 50. A front end 52 of the rotor can 34 is held within the central opening 50. A gasket 54 may be held between the front end 52 and the wall 48.

In an exemplary embodiment, the wall 48 includes power connector apertures 56 that receive power connectors 58 of the stator 40 and/or power connectors 60 of the control module 16. The power connectors 60 of the control module 16 are electrically connected to the plug assembly 18 and power is transmitted to the power connectors 58 via the power connectors 60. In the illustrated embodiment, the plug assembly 18 is represented by a line cord 202 with a corresponding pump plug 204 at a first end of the line cord 202. The line cord 202 includes an outlet plug 206 at an opposite end of the line cord 202. The outlet plug 206 is configured to be plugged into a power outlet 208 at a receptacle box. The control module 16 includes a power connector 210 that defines a plug interface 212 that is configured to interface with the plug assembly 18 and a plug assembly 300 (shown in FIG. 5). Both plug assemblies 18, 300 are configured to be coupled to the power connector 210. The power connector 210 selectively receives with the plug assembly 18 or the plug assembly 300, or another type of plug assembly, for receiving power into the control module 16. As such, the power connector 210 is configured to receive power from more than one type of plug assembly 18, 300. The plug assemblies 18, 300 differ from one another in that the plug assembly 18 is configured to be coupled to a power outlet, such as a three prong power outlet, whereas the plug assembly 300 is configured to be coupled to a cable that is routed from a central building junction box, where the cable is field wired to the plug assembly 300.

The power connectors 58 of the stator 40 are mated with the power connectors 60 of the control module 16 to create a power supply path from the control module 16 to the stator 40. The power connectors 58 are connected to corresponding coil windings 42, wherein power supplied to the power connectors 58 is transmitted to the coil windings 42.

The control module 16 includes a control box 62 that is mounted to a front end 64 of the stator housing 46. The control module 16 also includes a controller 66 received within the control box 62 and a user interface 68 integrated with the control box 62 and controller 66. The controller 66 and/or the user interface 68 may be electrically connected to the power connector 210. For example, power contacts 212 of the power connector 210 may extend into the control box 62 where the power contacts 212 are terminated to the controller 66. Optionally, the power contacts 212 may include pins at ends thereof that are received in corresponding plated vias 213 in the controller 66 to make electrical connection thereto. Alternatively, the power contacts 212 may have another type of connection, such as a socket, a solder pad, a spring beam, or the contacts 212 may be connected to the controller 66 by a wired connection that is soldered to the controller 66. The power contacts 212 may extend into a boss 214 of the power connector 210, which extends from the control box 62. The boss 214 is adapted for mating with the plug assembly 18 or the plug assembly 300. Optionally, the boss 214 may include a receptacle that receives either the plug assembly 18 or the plug assembly 300, depending on the particular power connection desired.

The boss 214 includes one or more keying features 216 that properly orient the plug assemblies 18, 300 with respect to the power connector 210. In the illustrated embodiment, the keying feature 216 is represented by an angled shoulder. The keying feature 216 may include one or more protrusions or slots that interact with corresponding features on the plug assemblies 18, 300.

In an exemplary embodiment, the plug assembly 18 includes a gasket 218 surrounding an outer surface 220 of the pump plug 204. The gasket 218 is loaded into the receptacle of the power connector 210 to seal the pump plug 204 to the power connector 210. The gasket 218 may engage the power connector 210 in an interference fit.

The plug assembly 18 includes a latching feature 222 (shown in FIG. 3), represented by an opening or catch that interacts with a corresponding latching feature 224 (shown in FIG. 3), represented by a protrusion or latch, on the power connector 210. When the plug assembly 18 is mounted to the power connector 210, the latching features 222, 224 interact to secure the plug assembly 18 to the power connector 210.

In the illustrated embodiment, the user interface 68 is integrated with the control box 62 and controller 66 by being directly mounted onto the control box 62 and electrically connected to the controller 66. In alternative embodiments, the user interface 68 may be integrated with the control box 62 and controller 66 without being mounted directly to the control box 62. For example, the user interface 68 may be positioned adjacent the pump assembly 10 or remote from the pump assembly 10 and still be integrated with the pump assembly 10. The user interface 68 may be mounted to another portion of the pump assembly 10, such as by being mounted to the stator housing 46 or another part of the pump assembly 10. The user interface 68 may be indirectly connected to the control box 62, such as by a mounting arm or other linking component that supports the user interface 68. The user interface 68 may be integrated with the pump assembly 10 by being physically positioned remote from the other components of the pump housing 10 but being connected to the pump assembly 10, such as the controller 66, by a communication link. Data may be transmitted between the user interface 68 and the controller 66 by the communications link. For example, an electrical cord may be connected between the user interface 68 and the controller 66 for sending data and/or power therebetween. The user interface 68 may be connected with the controller 66 by a wireless connection, wherein data is transmitted wirelessly therebetween. In the various embodiments, the user interface 68 may be conveniently positioned for access and viewing by the user.

In an exemplary embodiment, the user interface 68 is electrically connected to the controller 66. The user interface 68 includes a display 70 that outputs or relays information to a user and an input 72 that may be activated by a user to interact with the controller 66 and/or the pump assembly 10. The input 72 may include one or more buttons, keypads, keyboards, pointers, dials and the like that may be manipulated by the user, such as to change an operation of the controller 66 and/or the pump assembly 10. The input 72 may include one or more connectors that may be mated with a corresponding connector of another device or component, such as an external device or component that is not integrated with the pump assembly 10, but rather operates independently of the pump and is not connected to the pump assembly 10. The display 70 may have one or more readout, screen or other display component for conveying information to the user. The display 70 may be digital or analog. The user interface 68 may also include an output other than a visual output, such as an audio output, a wireless transmission output, and the like.

In an exemplary embodiment, the controller 66 controls the supply of power from the plug assembly 18 to the coil windings 42 via the power connectors 58, 60. For example, the controller 66 may control the amount of current supplied to the coil windings 42 and/or the timing of the power supply to the coil windings 42. Optionally, the power may be continuously supplied. Alternatively, the power may be pulsed at predetermined intervals, such as pulse modulated signal. When current is supplied to the coil windings 42, magnetic fields are created that induce rotation of the rotor shaft 30. The amount of power supplied may be variable and adjustable to change the rotor speed. A power circuit may be defined by any of the controller 66, the plug assembly 18, the power connectors 58, 60 and the coil windings 42. Electrical characteristics of the power circuit or any components thereof, such as the voltage frequency, the current and the like, may be measured by the controller 66 and used by the controller to determine operating characteristics of the pump assembly 10 and/or flow characteristics of the fluid moved by the pump assembly 10. Optionally, the electrical characteristics may be continuously monitored, or may be monitored at selected times, such as between pulsed signals.

The controller 66 monitors and/or measures electrical characteristics of the stator 40 which correspond to operating characteristics of the pump assembly 10. The operating characteristics of the pump assembly 10 may correspond to flow characteristics of the fluid moved through the pump assembly 10, such as water work, flow rate, pressure of the fluid, temperature of the fluid, the amount of heat energy used by the system (e.g. expressed in BTU) and the like. The controller 66 determines or calculates the flow characteristics of the fluid moved through the pump assembly 10 based on the measured operating characteristics. The controller 66 measures the power consumed by the pump assembly 10. For example, the controller 66 may measure the current supplied to the stator 40 and/or the current supplied to the power circuit. The controller 66 measures a frequency of the voltage of the power supply circuit and/or the stator 40. The controller 66 may determine a rotational speed of the rotor shaft 30 based on the frequency of the voltage. Optionally, the controller 66 may determine the rotations speed using a method similar to the method described in U.S. Pat. No. 7,043,395, the subject matter of which is incorporated by reference in its entirety. In an exemplary embodiment, the controller 66 determines a flow rate of the fluid moved through the pump assembly 10 based on the power consumed by the pump assembly 10, the measured current supplied to the power circuit and/or the stator 40 and the measured rotational speed of the rotor shaft 30. The controller 66 may determine the amount of heat energy used by the system based on the determined or measured flow rate and based on temperature measurements relating to the amount of heat lost or gained. The amount of heat energy may be expressed in BTU's. Optionally, the controller 66 may receive signals from one or more sensor that provides signals relating to flow characteristics, such as flow, pressure, temperature, shaft speed, power consumption and the like.

In operation, the arrangement of the rotor and stator 40 of the permanent magnet motor, as compared to other types of drive arrangements for pumps, provides very little slip of the rotor shaft 30. Due to the limited amount of slippage of the rotor shaft 30, the rotational speed of the rotor shaft 30 can be approximated very accurately across a wide range of speeds. As such, the use of the permanent magnet motor provides accurate measurements of rotor shaft rotational speeds, which are used by the controller 66 to determine the flow characteristics in an accurate manner.

The controller 66 sends one or more signals relating to the operating characteristics of the pump assembly 10 and/or the flow characteristics of the fluid moved through the pump assembly 10 to the display 70. For example, the controller 66 may send a signal relating to the flow rate or differential pressure of the fluid to the display 70, and the display 70 may display an output representative of the flow rate or differential pressure of the fluid moved through the pump assembly 10. The display 70 may additionally or alternatively display outputs representative of other operating characteristics and/or flow characteristics, such as power usage, operating status, operating mode, total flow, differential pressure, temperature and the like.

Figure 4:
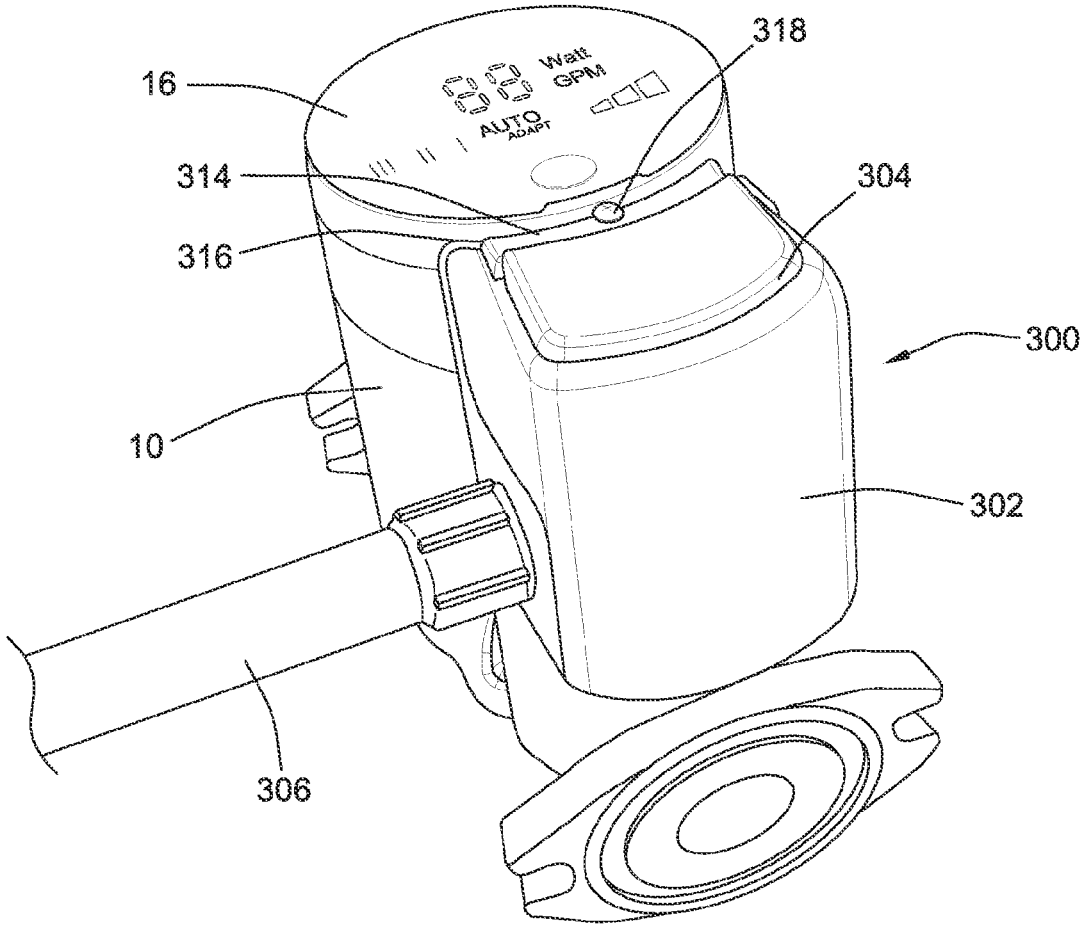
FIG. 4 is a perspective view of the pump assembly with a conduit box connected thereto.
Figure 5:
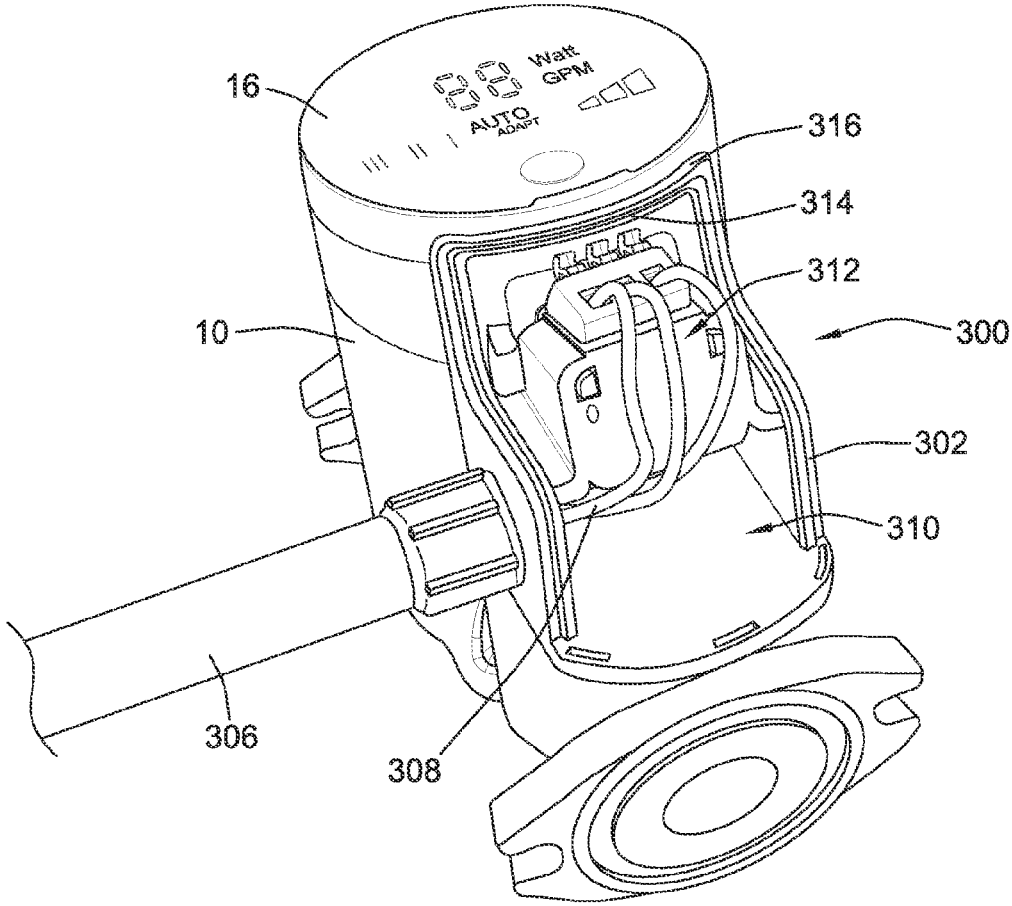
FIG. 5 is a perspective view of the pump assembly 10 with a portion of the conduit box removed.

FIG. 4 is a perspective view of the pump assembly 10 with the second plug assembly 300 connected thereto. FIG. 5 is a perspective view of the pump assembly 10 with a portion of the second plug assembly 300 removed. The pump assembly 10 includes a conduit box 302 coupled to the pump assembly 10. The plug assembly 300 is connected to the power connector 210 (shown in FIGS. 2 and 3). As shown in FIG. 4, the conduit box 302 includes a cover 304. FIG. 5 shows the conduit box 302 with the cover 304 removed.

The plug assembly 300 includes a conduit 306 having individual wires 308 routed therethrough. Optionally, the conduit 306 may be a rigid metal pipe. Alternatively, the conduit 306 may be a flexible conduit. The individual wires 308 are routed through the conduit 306 to the conduit box 302. The wires 308 extend into a wiring chamber 310 defined in the conduit box 302. The wiring chamber 310 defines an open space through which the wires 308 may be routed. The wires 308 are routed within the wiring chamber 310 to a contact subassembly 312. The wires 308 are terminated to the contact subassembly 312. As describe in further detail below, the contact subassembly 312 is connected to the power connector 210 when the plug assembly 300 is mounted to the pump assembly 10.

The conduit box 302 includes a mounting end 314 configured to be mounted to the control module 16 of the pump assembly 10. The mounting end 314 is curved to match a curvature of the contact module 16 such that the mounting end 314 of the conduit box 302 rests flush against the control module 16. A gasket 316 is provided between the mounting end 314 and the control module 16 to seal the conduit box 302 against the control module 16. Optionally, the cover 304 may include a gasket (not shown) along a sealing surface of the cover 304. As such, the cover 304 may be sealed to the conduit box 302. The cover 304 closes the conduit box 302 from the external environment surrounding the plug assembly 300. The cover 304 restricts access to the wiring chamber 310 and the contact subassembly 312 of the conduit box 302. Optionally, the cover 304 may be secured the conduit box 302 using a fastener 318.

Figure 6:
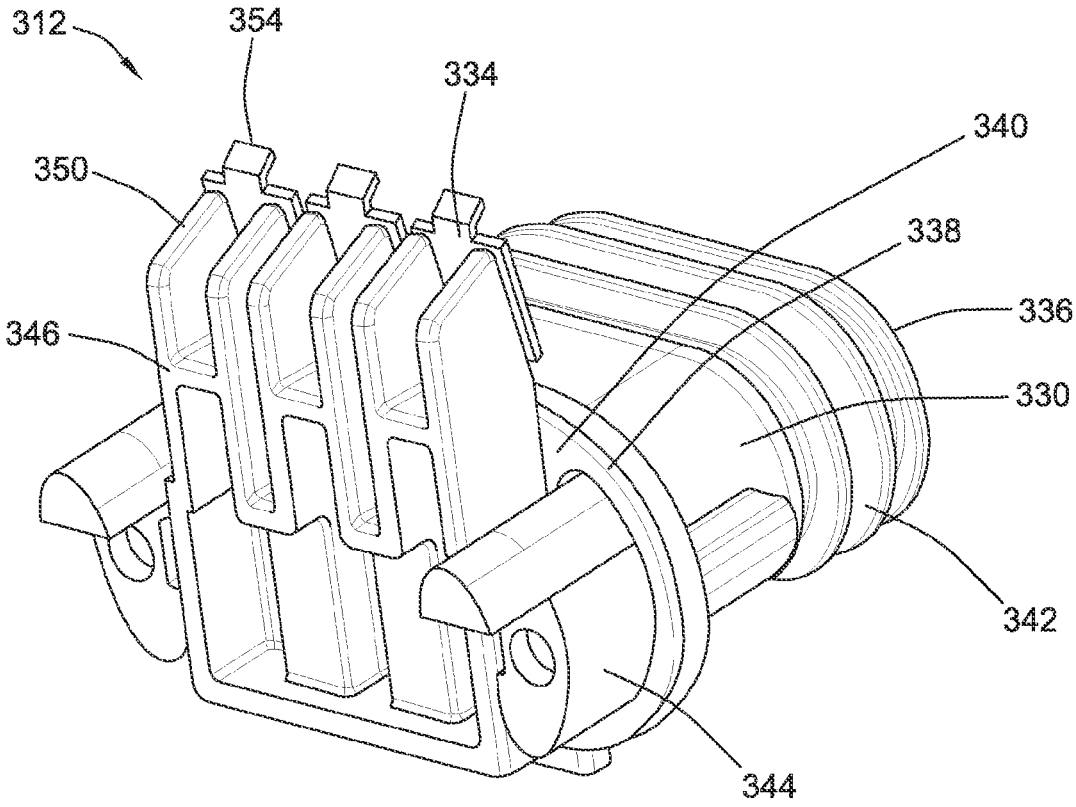
FIG. 6 illustrates a contact subassembly for the conduit box shown in FIG. 4.
Figure 7:
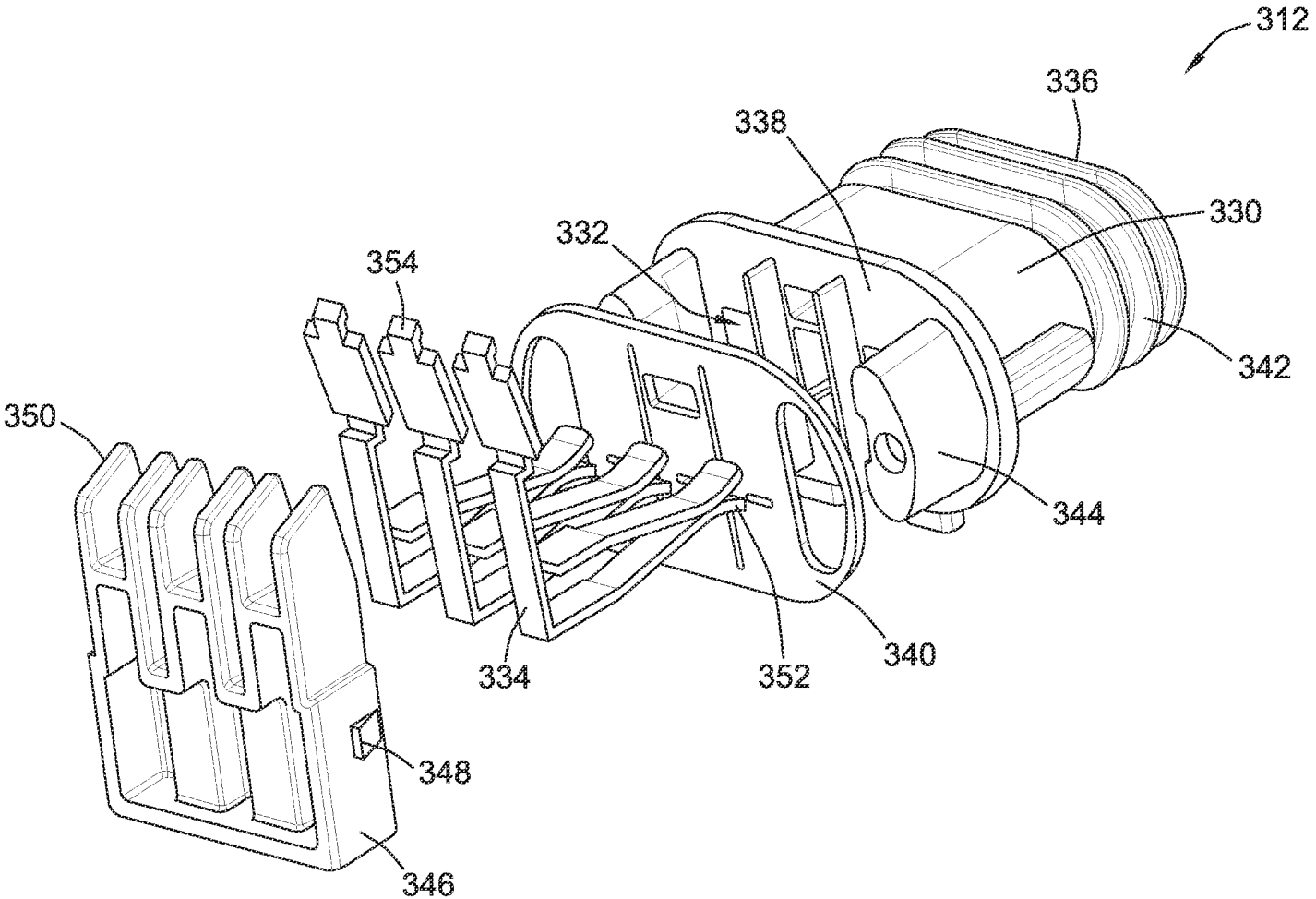
FIG. 7 is an exploded view of the contact subassembly shown in FIG. 6.

FIG. 6 illustrates the contact subassembly 312. FIG. 7 is an exploded view of the contact subassembly 312. The contact subassembly 312 includes a dielectric body 330 having contact channels 332 (shown in FIG. 7) that receive plug contacts 334 therein. The body 330 includes a mating end 336 and a loading end 338. The plug contacts 334 are loaded into the contact channels 332 through the loading end 338.

A gasket 340 is secured to the body 330 at the loading end 338. A mating gasket 342 surrounds the body 330 proximate to the mating end 336. When the plug assembly 300 (shown in FIGS. 4 and 5) is coupled to the power connector 210 (shown in FIGS. 2 and 3), the body 330 is loaded into the receptacle of the power connector 210 such that the mating gasket 342 seals against the power connector 210.

In an exemplary embodiment, mounting fingers 344 extend rearward from the loading end 338. The mounting fingers 344 are used to secure the contact subassembly 312 to the conduit box 302. Other types of securing features may be used in alternative embodiments to secure the contact subassembly 312 to the conduit box 302.

In an exemplary embodiment, the contact subassembly 312 includes a cage 346 mounted to the loading end 338 of the body 330. The cage 346 supports the plug contacts 334. The cage 346 includes protrusions 348 extending from sidewalls thereof to secure the cage 346 to the body 330. The cage 346 includes a top end 350 that supports ends of the plug contacts 334. In an exemplary embodiment, the cage 346 extends generally perpendicular to the body 330. The top 350 is elevated above the body 330 to support the plug contacts 334 above the body 330. The cage 346 may have a different size and shape or orientation in alternative embodiments. For example, the cage 346 may extend generally parallel from the body 330 and support the plug contacts 334 generally along a plane defined by the body 330. In another alternative embodiment, the cage 346 may be formed integral to the body 330.

The plug contacts 334 include a mating end 352 and wire terminating end 354. The mating end 352 is loaded into the contact channels 332. The wire terminating end 354 is exposed exterior of the body 330. The mating end 352 is configured to be mated to the power contacts 212 (shown in FIGS. 2 and 3) of the power connector 210. In the illustrated embodiment, the plug contacts 334 define a socket at the mating end 352 that is configured to receive the power contacts 212 therein. Alternatively, the plug contacts 334 may have a different type of contact at the mating end 352. For example, the plug contacts 334 may have pins, or spring beams, at the mating end 352 for mating to corresponding power contacts 212.

The wire terminating end 354 is configured to be terminated to wires 308 (shown in FIGS. 4 and 5). Optionally, as will be described in further detail below, the wire terminating ends 354 may be terminated by pressing the wire terminating ends 354 against the wires 308 to ensure electrical contact therebetween. Alternatively, the wire terminating ends 354 may be terminated to the wires 308 using insulation displacement type contacts. In other alternative embodiments, the wire terminating ends 354 may be crimped to the wires 308 or soldered to the wires 308 to make mechanical and electrical connections therebetween. When assembled, the cage 346 and the body 330 cooperate to support the plug contacts 334 for mating with the power contacts 212 and wires 308. As such, the plug contacts 334 define an electrical path between the wires 308 and the power contacts 212 of the power connector 210.

Figure 8:
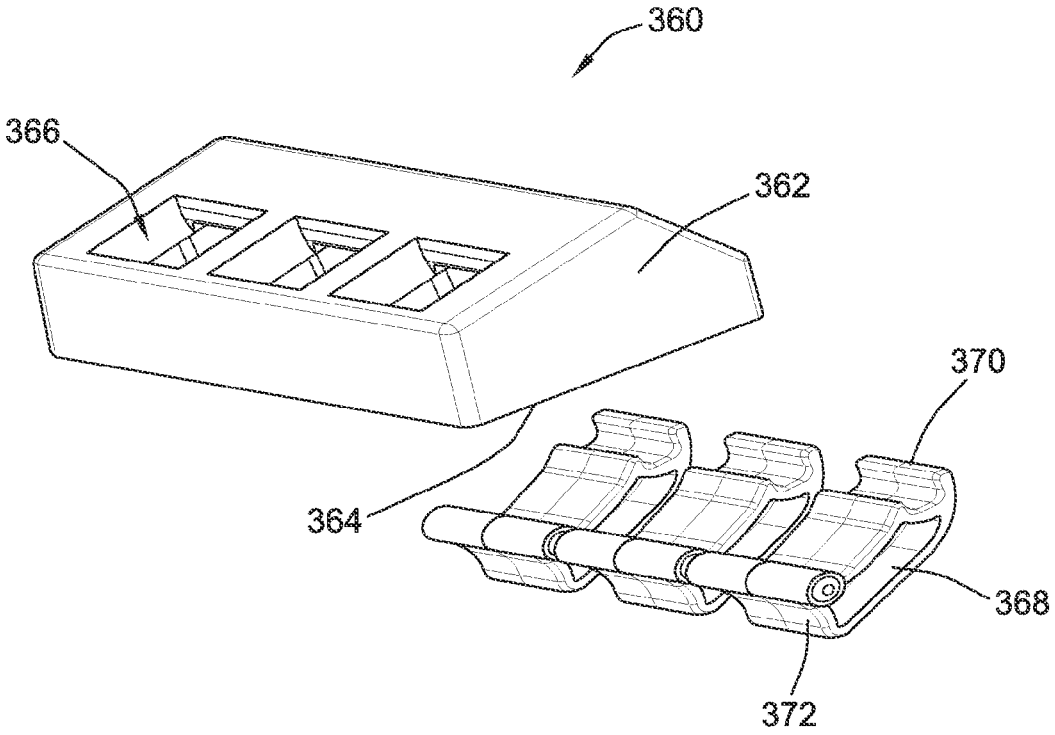
FIG. 8 illustrates a lever assembly for the conduit box shown in FIG. 4.

FIG. 8 illustrates a lever assembly 360 of the plug assembly 300. The lever assembly 360 includes a lever housing 362 having a bottom 364. The lever housing 362 includes a plurality of openings 366 extending therethrough. The openings 366 receive the wires 308 (shown in FIGS. 4 and 5). The openings 366 also receive the wire terminating ends 354 of the plug contacts 334 (both shown in FIGS. 6 and 7). The plug contacts 334 are configured to be terminated to the wires 308 in the openings 366.

The lever assembly 360 includes a plurality of levers 368. The levers 368 are rotatably coupled to the lever housing 362. The levers 368 extend between a first end 370 and a second end 372. The first end 370 is configured to be pressed by an operator during termination of the wires 308 to the plug contacts 334. When the first end 370 is pressed, the lever 368 is rotated such that the second end 372 engages the plug contact 334. The second end 372 pushes the plug contact 334 to an open position to allow the wire 308 to be loaded into the opening 366, and positioned with respect to the plug contact 334, such that when the lever 368 is released, the plug contact 334 engages the wire 308 and captures the wire 308 against the wire terminating end 354 of the plug contact 334.

Figure 9:
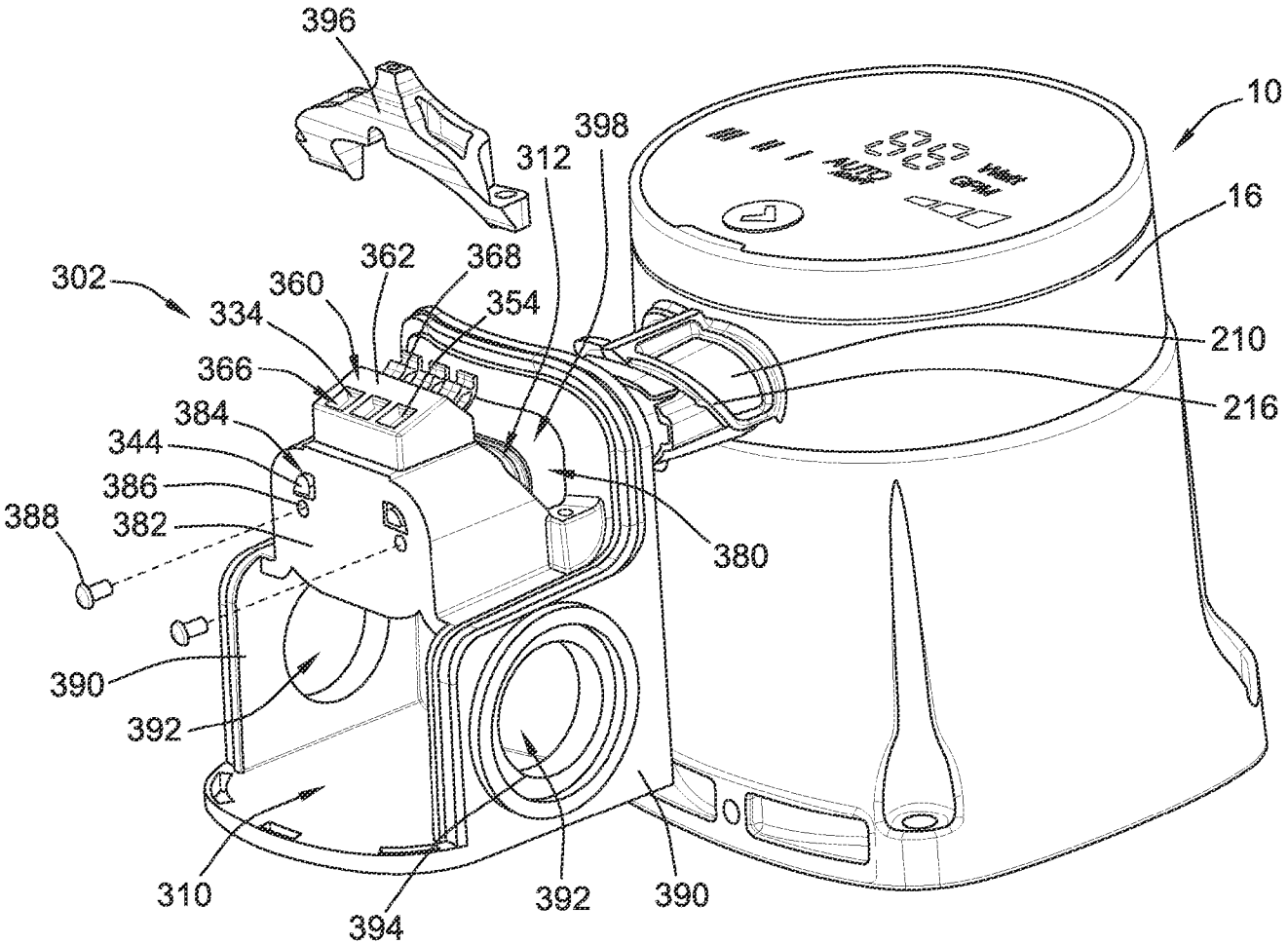
FIG. 9 is an exploded view of the conduit box and pump assembly.

FIG. 9 is an exploded view of the plug assembly 300 and pump assembly 10. The power connector 210 is shown extending from the contact module 16 of the pump assembly 10. The conduit box 302 is aligned with the power connector 210 for mating thereto.

The conduit box 302 includes the wiring chamber 310 and a connector chamber 380. The contact subassembly 312 is positioned within the connector chamber 380. The contact subassembly 312 is secured to a hood 382 of the conduit box 302. In an exemplary embodiment, the hood 382 includes openings 384 that receive a portion of the mounting fingers 344. Fastener bores 386 are also provided through the hood 382. In the illustrated embodiment, the fastener bores 386 are aligned below the openings 384. The fastener bores 386 receive fasteners 388 therein that secure the contact subassembly 312 to the hood 382.

The conduit box 302 includes sidewalls 390. Optionally, the sidewalls 390 may include ports 392 that receive the wires 308 (shown in FIG. 5) therethrough. The conduit 306 (shown in FIGS. 4 and 5) is coupled to the conduit box 302 at the one of the ports 392. A seal 394 may be provided around the port 392 to seal against the conduit 306. Optionally, a cap (not shown) may be coupled to the port 392 that is not being used.

The lever assembly 360 is coupled to the hood 382. For example, the bottom 364 of the lever housing 362 is mounted on the hood 382. The lever assembly 360 may be provided proximate to the contact subassembly 312. When assembled, the plug contacts 334 may extend into the openings 366 in the lever housing 362. During assembly, the wires 308 are routed into the wiring chamber 310 to the corresponding openings 366 of the lever assembly 360. The lever 368 is actuated to provide clearance between the wire terminating end 354 and the lever housing 362. When clearance is provided, the wire 308 may be loaded into the opening 366 between the wire terminating end 354 and the lever housing 362. When the lever 368 is released, the wire terminating end 354 is also released biasing the wiring terminating end 354 against the wire 308. The wire 308 is captured between the wire terminating end 354 and the lever housing 362, and held therebetween by a spring force of the plug contact 334.

The plug assembly 300 includes a locking harness 396 that is configured and coupled to the conduit box 302 to the power connector 210. The conduit box 302 includes a window 398 proximate to the hood 382. The window 398 provides access to the connector chamber 380. When the conduit box 302 is loaded onto the power connector 210 the power connector 210 is exposed through the window 398. The locking harness 396 is then coupled to the conduit box 302 to secure the conduit box 302 to the power connector 210. In an exemplary embodiment, the keying feature 216, represented by the angled shoulder, is exposed through the window 398. The locking harness 396 is coupled to the conduit box 302 such that the keying feature 216 is captured between the conduit box 302 and the locking harness 396.

Figure 10:
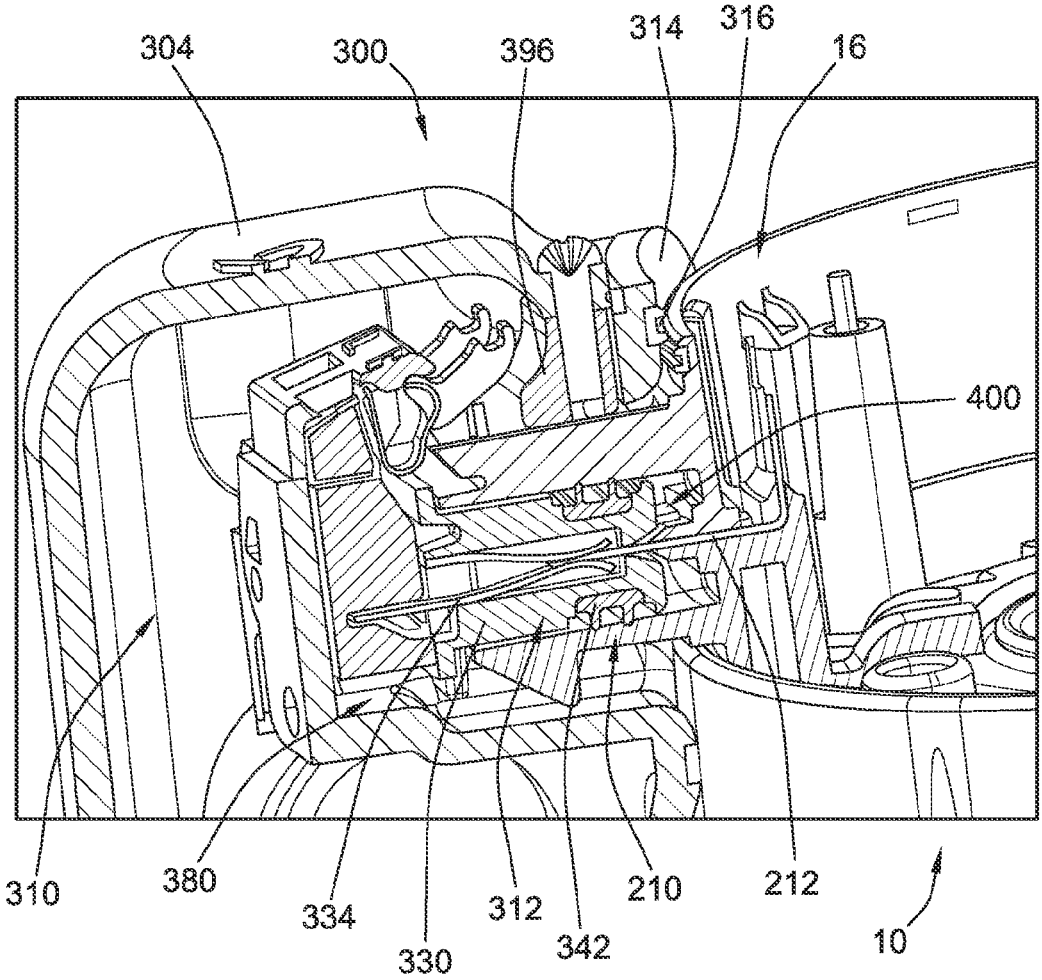
FIG. 10 is a cross sectional view of the conduit box coupled to the pump assembly.

FIG. 10 is a cross-sectional view of the plug assembly 300 coupled to the pump assembly 10. When assembled, the contact subassembly 312 is electrically connected to the power connector 210. The plug contacts 334 are terminated to the power contacts 212. When assembled, the body 330 is loaded into the receptacle 400 defined by the power connector 210. The mating gasket 342 is sealed against an inner surface of the receptacle 400. The locking harness 396 secures the plug assembly 300 to the power connector 210. The gasket 316 is provided between the mounting end 314 and the control module 16. The gasket 316 seals the plug assembly 300 against the contact module 16. When assembled, the cover 304 covers the wiring chamber 310 and the connector chamber 380. The cover 304 is secured using the fastener 318. Optionally, the fastener 318 may be secured to the locking harness 396.

Figure 11:
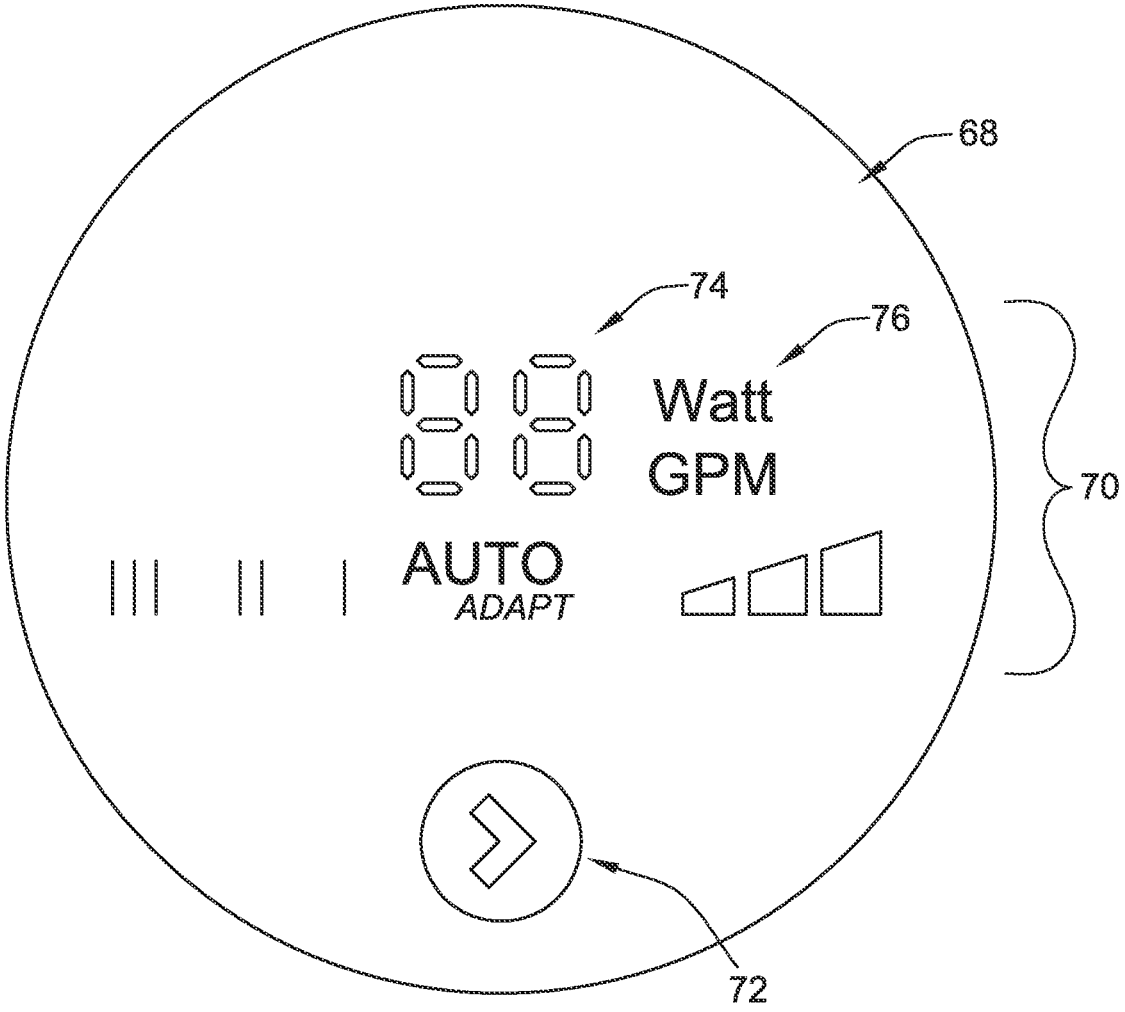
FIG. 11 illustrates a user interface integrated with the pump assembly shown in FIG. 1.

FIG. 11 illustrates the user interface 68 that is integrated with the pump assembly 10 (shown in FIG. 1). In the illustrated embodiment, the input 72 is represented by a push button that selects different functions or operation modes for the pump assembly 10. For example, in an exemplary embodiment, the pump assembly 10 may operate in three different modes of operation. The pump assembly 10 may operate in a fixed speed mode, the pump assembly 10 may operate in a constant pressure mode, and the pump assembly 10 may operate in an AUTOAdapt mode wherein the pump assembly 10 automatically adapts to the system load on the pump assembly 10. The pump assembly 10 may operate in other modes in alternative embodiments such as a constant flow mode where the flow rate is held at a constant level. Optionally, in the fixed speed mode, the pump assembly 10 may have multiple speeds. In the illustrated embodiment, the pump assembly 10 has three fixed speeds identified as I, II, III. Optionally, in the constant pressure mode, the pump assembly 10 may operate at different levels of constant pressure. In the illustrated embodiment, the pump assembly 10 has three levels of constant pressure identified by the three sloped bars of different height. In the AUTOAdapt mode, the pump assembly 10 may have a variable speed and/or variable pressure depending on the load on the pump assembly 10.

In the illustrated embodiment, the display 70 is represented by a readout. The display 70 has a numerical readout section 74 that displays one or more digits representative of an output. The display 70 has an indicator section 76 that includes one or more indicators that relate to the numerical readout section 74. For example, in illustrated embodiment, the indicator section 76 has a Watt indicator and a GPM indicator representative of a power consumption and a flow rate, respectively. The power consumption and the flow rate may be represented by different indicators in alternative embodiments. For example, rather than displaying a numerical output, the output may be graphical or an analog display. Additionally, other types of indicators may be provided in other alternative embodiments, such as a pressure indicator. The particular characteristic represented in the numerical readout section 74 may be lit up or otherwise identified in the indicator section 76. For example, the numerical readout section 74 may cycle between a number indicative of power consumption and a number indicative of flow rate, where the particular Watt or GPM indicator is lit up corresponding to the particular number shown in the numerical readout section 74.

Figure 12:
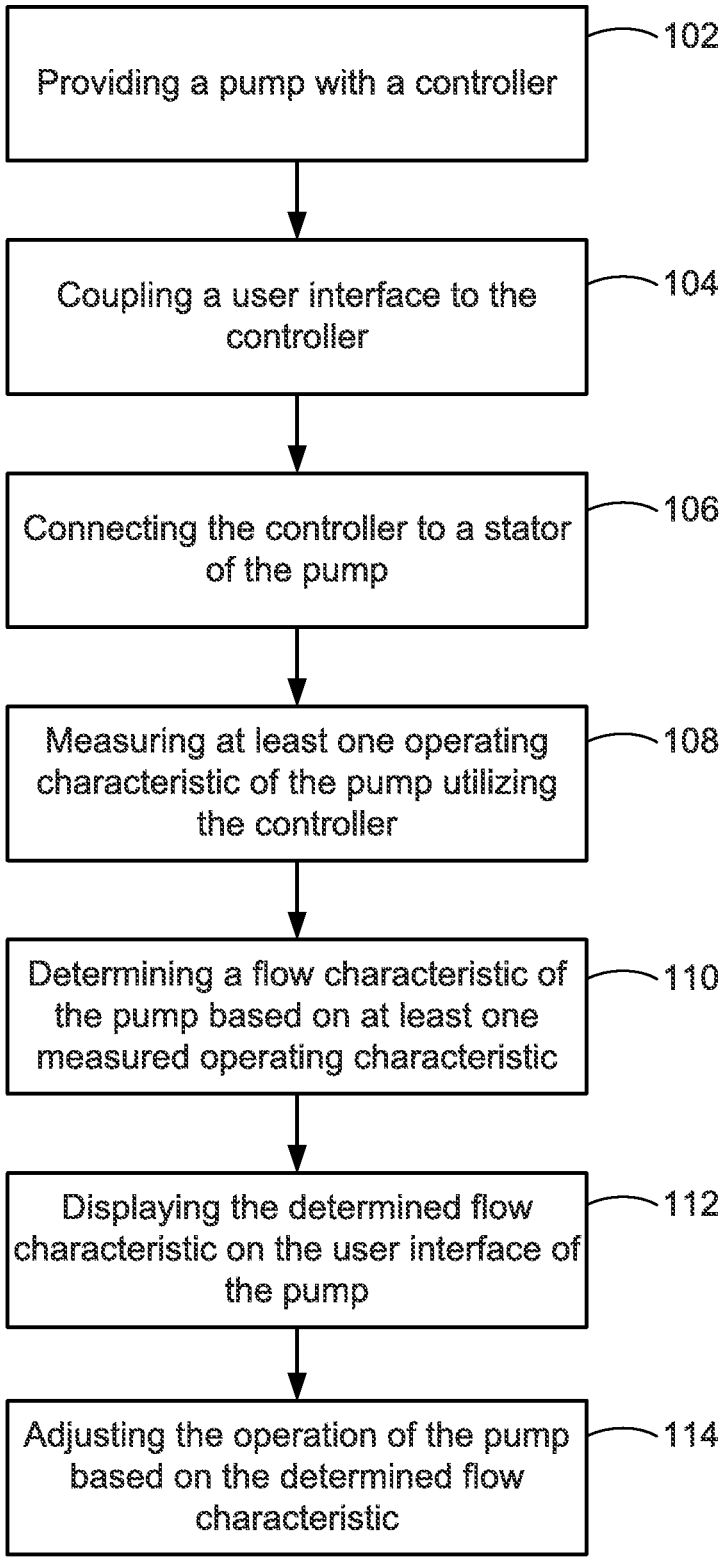
FIG. 12 is a flow chart showing an exemplary method of operating the pump assembly shown in FIG. 1.

FIG. 12 is a flow chart showing an exemplary method of operating the pump assembly 10 (shown in FIG. 1). The method may include any combination of the following steps depending on the particular application. The method is described in terms of a pump similar to the pump assembly 10 described above being a permanent magnet motor pump having a controller with a user interface that displays on a user interface information relating to the operation of the pump and/or information relating to flow characteristics of the fluid moved by the pump.

The method includes providing 100 a pump with a controller within a housing of the pump. The method includes mechanically and electrically coupling 102 the user interface to the controller. The method includes coupling 104 a power source to the pump. The method includes connecting 106 the controller to the stator and/or the coil windings of the stator such that power supplied to the stator may be controlled by the controller.

The method includes measuring 108 at least one operating characteristic of the pump utilizing the controller integrated with the pump. The measuring 108 may include measuring a current supplied to the pump. The measuring 108 may include measuring a speed of a rotor of the pump. The measuring 108 may include measuring at least one operating characteristic of the stator of the permanent magnet motor pump. The measuring 108 may include measuring a voltage frequency of the coil windings. The measuring 108 may include measuring a power supply provided to the pump, such as a rectified supply voltage, a DC voltage, or another power supply value. The measuring 108 may include measuring other characteristics of the pump, where the measured characteristics relate to or may be used by the controller to calculate or determine other operating characteristics of the pump and/or to calculate or determine flow characteristics of the fluid moved by the pump.

The method includes determining 110 a flow characteristic of the pump based on the at least one measured operating characteristic. For example, the water work, flow rate, pressure or other flow characteristic may be determined. In an exemplary embodiment, the step of determining 110 the flow characteristic of the pump is performed without the use of a separate sensor, such as a flow sensor or pressure sensor measuring the flow rate or pressure of the throughput of the pump. Rather, the controller includes hardware and/or software components that calculate or otherwise determine the flow characteristic of the fluid moved through the pump based on operating characteristics of the pump, such as operating characteristics of the stator. No additional connection to a separate flow sensor is needed to determine the flow rate. Additionally, the flow characteristic may be determined without actually measuring or otherwise interacting with the fluid being moved through the pump. Optionally, the controller may include one or more look-up tables to determine the flow characteristic based on the measured operating characteristic. Optionally, the controller may include a microprocessor or other component having software or other programs that determine the flow characteristic of the fluid moved through the pump using the measured operating characteristics. The controller may use an algorithm or other formula to determine the flow characteristic based on characteristics of the stator. In an exemplary embodiment, the controller determines the flow characteristic of the pump based on a measured power supply to the pump and a speed of the rotor. The speed of the rotor may be determined based on an operating characteristic of the stator, such as a frequency of the voltage of the power supply or the frequency of the voltage of the stator or the frequency of the stator field. As such, the controller only needs to be connected to or otherwise receive signals from the stator to determine the flow characteristic, as opposed to monitoring or measuring the rotor or the fluid.

The method also includes displaying 112 the determined flow characteristic on the user interface integrated with the pump. The flow characteristic may be displayed in any fashion and on any type of display integrated with the pump. For example, the flow characteristic may be displayed on the display 70 (shown in FIG. 4). Other types of display are possible in alternative embodiments. The user interface may be directly connected to the controller to receive signals from the controller relating to the flow characteristic for display.

The method includes adjusting 114 the operation of the pump based on the determined flow characteristic or other measured operating characteristic. For example, the controller may change the mode of operation based on the determined flow characteristic or other measured operating characteristic. The controller may change the power supplied to the stator. The controller may change the rotor speed. The controller may change other pump operations. As described above, the pump may be operated at a number of different speeds, the pump may be operated at different constant pressures, the pump may be operated in the AUTOAdapt mode, or the pump may be operated in other operation modes (e.g. constant flow mode or constant pressure mode). The controller may adjust between different speeds or different constant pressures or one of the other modes of operation based on the determined flow characteristic or other measured operating characteristic.

Figure 13:
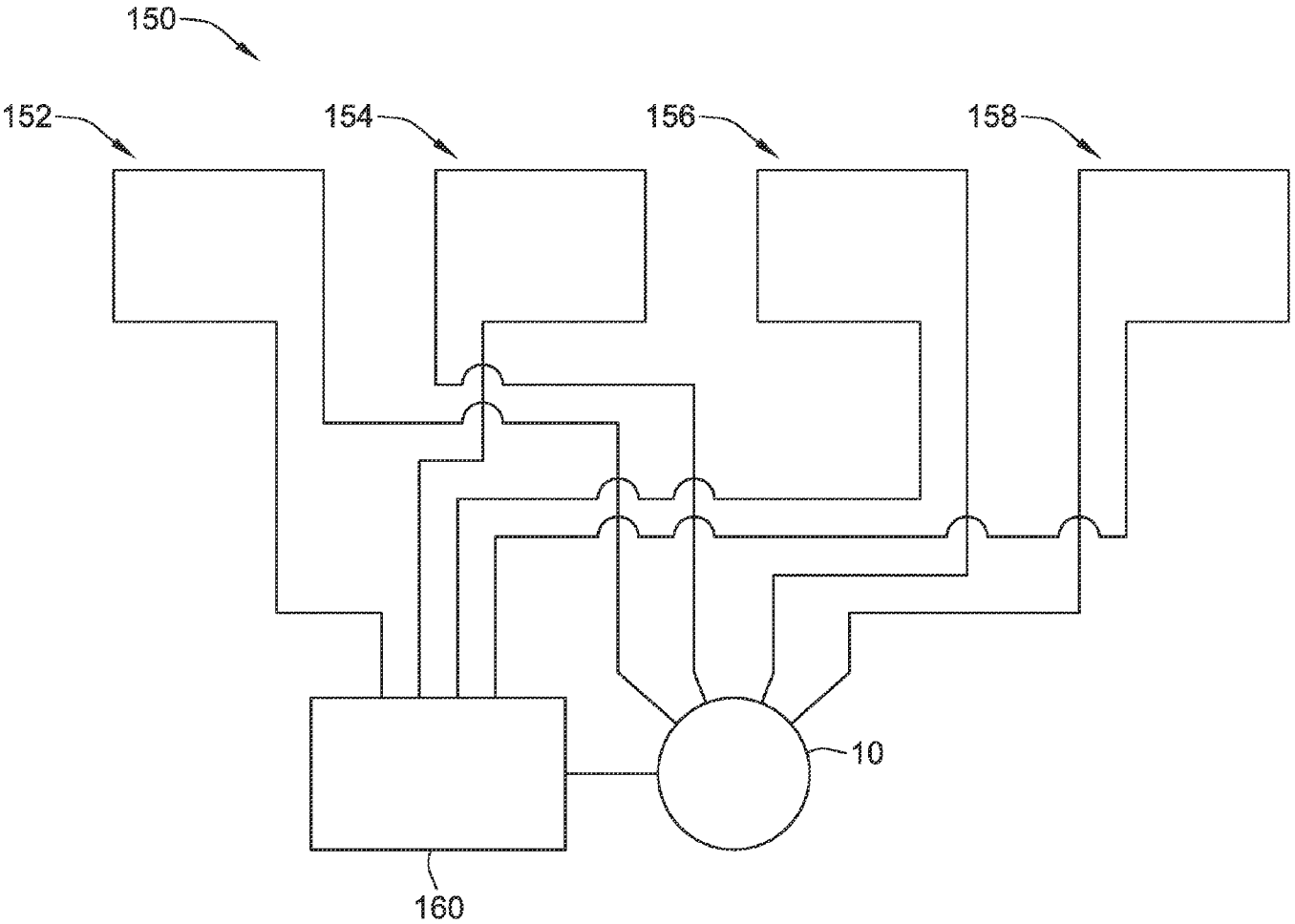
FIG. 13 is a schematic illustration of a heating system utilizing the pump assembly shown in FIG. 1 in accordance with an exemplary embodiment.

FIG. 13 is a schematic illustration of a heating system 150 utilizing the pump assembly 10 in accordance with an exemplary embodiment. The pump may be used in other types of systems in other embodiments, and the heating system 150 is merely illustrative of one exemplary embodiment. The heating system 150 includes multiple zones or circuits 152, 154, 156, 158. The pump assembly 10 supplies fluid flow through the various zones 152-158. Control valves are provided to control the flow of fluid through the particular zones 152-158. When a particular valve is open, the pump assembly 10 moves fluid through the particular zone 152-158. The pump assembly 10 may receive fluid from a supply 160, which may be a reservoir, a manifold, a supply pipe, a heat exchanger, and the like.

The operation of the pump assembly 10 depends on demand within the zones 152-158. When demand in any of the zones 152-158 is required, the pump assembly 10 may be operated and/or may be operated differently. For example, when the pump assembly 10 is operating to supply fluid to only one zone, such as the first zone 152, and then demand is required in another zone, such as the second zone, the pump assembly 10 may increase output, such as by increasing speed. Alternatively, the pump assembly 10 may provide the same output, but the amount of fluid supplied to the first zone 152 may decrease when the pump assembly 10 starts supplying fluid to the second zone 154.

In operation, it may be useful for the operator of the heating system 150 to be aware of one or more flow characteristics of the fluid supplied by the pump assembly 10. For example, the operator may want to change the operation mode of the pump assembly 10 if the flow rate is in a particular range or above or below a particular rate. Additionally, it may be useful for the operator to observe the flow rate of the pump assembly 10 during a configuration of the heating system 150. For example, when setting up the heating system 150, the operator may want to observe the flow rate as the operator cycles through the different zones to determine how the pump assembly 10 operates, particularly the throughput of the pump in terms of flow rate, when different combinations of the zones 152-158 are opened and closed. It may be useful for the operator to observe the flow rate of the pump assembly 10 during a diagnostic test of the heating system 150 or the pump assembly 10. There are many other reasons that a user may want to know the flow rate of the fluid moved through the pump assembly 10. Additionally, by using a pump that determines the flow rate by measuring operating characteristics of the pump assembly 10 rather than by monitoring the actual flow rate of the fluid, such as with a separate flow sensor, a compact and robust system is provided with less components, less complexity, less set up time, and potentially less cost. By using a permanent magnet motor, an accurate rotational speed of the rotor may be known by monitoring an electrical characteristic of the stator, such as the frequency of the voltage of the stator. A direct correlation between such measured electrical characteristic and the rotational speed of the rotor is provided because the rotor of the permanent magnet motor has very little slip, as compared to non-permanent magnet motor type pumps. The user may also want to know other flow characteristics other than the flow rate, such as the pressure of the fluid. As such, the pressure may be displayed on the display of the user interface.

Figure 14:
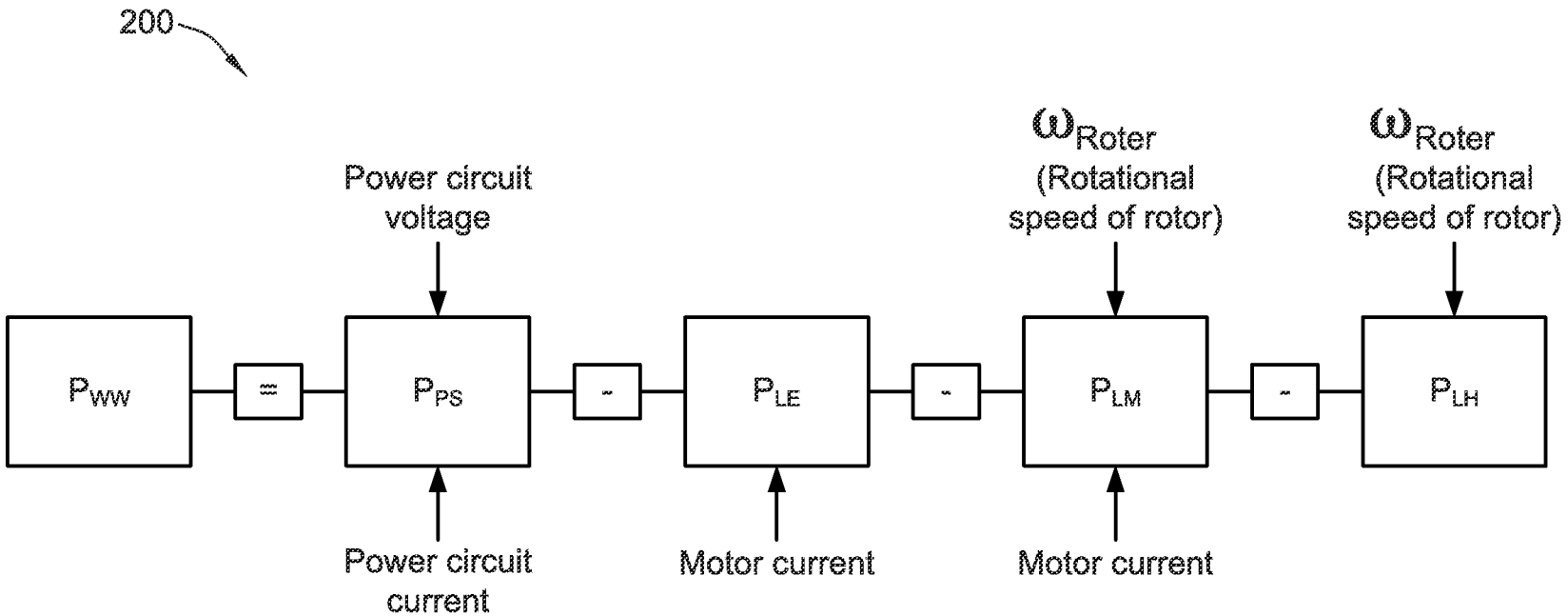
FIG. 14 is a power balance equation used by the pump assembly to determine flow characteristics.

FIG. 14 is a power balance equation 200 used by the pump assembly to determine flow characteristics. In the equation 200, PWW relates to the power resulting in water work; PPS relates to the power supply consumed; PLE relates to the power loss due to the electronics; PLM relates to the power loss due to the motor; and PLH relates to the power loss due to hydraulics. The power PPS may be determined by measuring the voltage of the power supply, such as by directly or indirectly measuring the voltage of the power circuit, and by measuring the current in the power circuit. The power PLE may be determined by measuring the current in the motor. The power PLM may be determined by measuring the current in the motor and by measuring or calculating the rotational speed of the rotor. The power PLH may be determined by measuring or calculating the rotational speed of the rotor. In an exemplary embodiment, the rotational speed of the rotor may be determined based on the frequency of the stator field.

Different flow characteristics may be determined based on the power balance equation 200. For example, the power resulting in water work $P_{WW}$ may be used to determine flow characteristics such as flow rate (Q) and pressure (H). For example, $P_{WW}$ may be expressed according to the following equation:

$$P_{WW}=PQ+PH \tag{1}$$

Where PQ is the power used for generating flow (Q) and PH is the power used for generating pressure (H). PQ may be expressed according to the following equation:

$$PQ=AQ^2+BQ+C=0 \tag{2}$$

Where A is a known constant times the rotational speed of the rotor (ω), B is a different known constant times the rotational speed of the rotor (ω) and C is equal to $P_{LH}$. The known constants may be based on the type of pump assembly used, and may be based on the particular impeller and/or volute of the pump assembly.

Once the power used to generate flow is known, the pressure may be found according to the following equation:

$$dp=aQ^2+bQ\omega+c\omega^2 \tag{3}$$

Where dp is the differential pressure, a is a known constant, Q is the flow rate, b is a different known constant, c is another known constant, and ω is the rotational speed of the rotor.

As described above, the controller 66 measures the electrical characteristics of the motor, and based on the measured characteristics, determines flow characteristics such as water work, flow rate and pressure. The controller 66 is connected to the user interface 68 such that the flow characteristics may be displayed thereon.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A pump assembly comprising:

a pump housing;

a motor coupled to the pump housing, the motor being operated to drive fluid through the pump housing;

a control module operatively coupled to the motor, the control module having a power connector with power contacts, the power connector having a plug interface; and first and second plug assemblies configured to be selectively coupled to the power connector, the first and second plug assemblies having first and second mating interfaces both configured to mate with the plug interface of the power connector, wherein the first plug assembly includes a line cord having a pump plug at one end of the line cord and an outlet plug at an opposite end of the line cord, and wherein the second plug assembly includes a conduit box having plug contacts configured to be field wired to a power cable within the conduit box;

wherein the first and second plug assemblies each include a gasket defining a portion of the first and second mating interfaces, respectively, the first plug assembly being selectively coupled to the power connector such that the gasket at the first mating interface engages the power connector by an interference fit to seal the first plug assembly to the power connector, the second plug assembly being selectively coupled to the power connector such that the gasket at the second mating interface engages the power connector by an interference fit to seal the second plug assembly to the power connector.

2. The pump assembly of claim 1, wherein the first and second plug assemblies are removably coupled to the power connector.

3. The pump assembly of claim 1, wherein the first and second mating interfaces are substantially identical to one another, the first plug assembly removably coupled to the power connector such that a separable interface is defined between the plug interface and the first mating interface, the second plug being removably coupled to the power connector such that a separable interface is defined between the plug interface and the second mating interface.

4. The pump assembly of claim 1, wherein the power connector includes a boss extending outward therefrom, the boss defining a portion of the plug interface, the boss having a cavity configured to selectively receive the first plug assembly or the second plug assembly.

5. The pump assembly of claim 1, wherein the power connector includes a boss extending outward therefrom, the boss having a keying feature to orient the first plug assembly or the second plug assembly with respect to the power connector.

6. The pump assembly of claim 1, wherein the conduit box includes a wiring chamber and a connector chamber, the second plug assembly further includes a contact subassembly being positioned in the connector chamber for mating with the power contacts, wherein the wiring chamber is configured to receive the power cable for field wiring individual wires of the power cable to the contact subassembly.

7. The pump assembly of claim 1, wherein the second plug assembly includes a contact subassembly received in the conduit box, the contact subassembly having a dielectric body having contact channels receiving plug contacts therein, the gasket surrounding the dielectric body, the dielectric body being received in the power connector such that the gasket seals against the power connector.

8. The pump assembly of claim 1, wherein the control module includes a circuit board, the power contacts being terminated to the circuit board.

9. The pump assembly of claim 1, wherein the control module includes a circuit board and a display mounted to the circuit board, the power contacts being terminated to the circuit board, wherein the first plug assembly is configured to be selectively coupled to the power connector to provide power to the circuit board for the display, and wherein the second plug assembly is configured to be selectively coupled to the power connector to provide power to the circuit board for the display.

10. A pump assembly comprising:

a pump housing;

a motor coupled to the pump housing, the motor being operated to drive fluid through the pump housing;

a control module operatively coupled to the motor, the control module having a power connector with power contacts, the power connector having a plug interface; and first and second plug assemblies configured to be selectively coupled to the power connector, the first and second plug assemblies having first and second mating interfaces both configured to mate with the plug interface of the power connector, wherein the first plug assembly includes a line cord having a pump plug at one end of the line cord and an outlet plug at an opposite end of the line cord, and wherein the second plug assembly includes a conduit box having plug contacts configured to be field wired to a power cable within the conduit box;

wherein the second plug assembly includes a contact subassembly held within the conduit box, the contact subassembly holding plug contacts configured to be mated with corresponding power contacts, the second plug assembly further including a lever subassembly held within the conduit box proximate to the contact subassembly, the lever subassembly having levers biasing the plug contacts to an open position to receive wires of the power cable.

11. The pump assembly of claim 10, wherein the first and second plug assemblies are removably coupled to the power connector.

12. The pump assembly of claim 10, wherein the first and second mating interfaces are substantially identical to one another, the first plug assembly removably coupled to the power connector such that a separable interface is defined between the plug interface and the first mating interface, the second plug being removably coupled to the power connector such that a separable interface is defined between the plug interface and the second mating interface.

13. The pump assembly of claim 10, wherein the power connector includes a boss extending outward therefrom, the boss defining a portion of the plug interface, the boss having a cavity configured to selectively receive the first plug assembly or the second plug assembly, the boss having a keying feature to orient the first plug assembly or the second plug assembly with respect to the power connector.

14. The pump assembly of claim 10, wherein the conduit box includes a wiring chamber and a connector chamber, the second plug assembly further includes a contact subassembly being positioned in the connector chamber for mating with the power contacts, wherein the wiring chamber is configured to receive the power cable for field wiring individual wires of the power cable to the contact subassembly.

15. The pump assembly of claim 10, wherein the control module includes a circuit board and a display mounted to the circuit board, the power contacts being terminated to the circuit board, wherein the first plug assembly is configured to be selectively coupled to the power connector to provide power to the circuit board for the display, and wherein the second plug assembly is configured to be selectively coupled to the power connector to provide power to the circuit board for the display.

16. A pump assembly comprising:

a pump housing;

a motor coupled to the pump housing, the motor being operated to drive fluid through the pump housing;

a control module operatively coupled to the motor, the control module having a power connector with power contacts, the power connector having a plug interface; and first and second plug assemblies configured to be selectively coupled to the power connector, the first and second plug assemblies having first and second mating interfaces both configured to mate with the plug interface of the power connector, wherein the first plug assembly includes a line cord having a pump plug at one end of the line cord and an outlet plug at an opposite end of the line cord, and wherein the second plug assembly includes a conduit box having plug contacts configured to be field wired to a power cable within the conduit box;

wherein the second plug assembly includes a locking harness separate from the conduit box, the conduit box having a window therethrough, the conduit box being coupled to the power connector such that the power connector is exposed through the window, the locking harness being coupled to the conduit box proximate to the window such that the locking harness engages the power connector through the window.

17. The pump assembly of claim 16, wherein the first and second plug assemblies are removably coupled to the power connector.

18. The pump assembly of claim 16, wherein the first and second mating interfaces are substantially identical to one another, the first plug assembly removably coupled to the power connector such that a separable interface is defined between the plug interface and the first mating interface, the second plug being removably coupled to the power connector such that a separable interface is defined between the plug interface and the second mating interface.

19. The pump assembly of claim 16, wherein the power connector includes a boss extending outward therefrom, the boss defining a portion of the plug interface, the boss having a cavity configured to selectively receive the first plug assembly or the second plug assembly, the boss having a keying feature to orient the first plug assembly or the second plug assembly with respect to the power connector.

20. The pump assembly of claim 16, wherein the conduit box includes a wiring chamber and a connector chamber, the second plug assembly further includes a contact subassembly being positioned in the connector chamber for mating with the power contacts, wherein the wiring chamber is configured to receive the power cable for field wiring individual wires of the power cable to the contact subassembly.

21. The pump assembly of claim 16, wherein the control module includes a circuit board and a display mounted to the circuit board, the power contacts being terminated to the circuit board, wherein the first plug assembly is configured to be selectively coupled to the power connector to provide power to the circuit board for the display, and wherein the second plug assembly is configured to be selectively coupled to the power connector to provide power to the circuit board for the display.

22. A pump assembly comprising:

a pump housing;

a motor coupled to the pump housing, the motor being operated to drive fluid through the pump housing;

a control module operatively coupled to the motor, the control module having a power connector with power contacts, the power connector having a plug interface; and first and second plug assemblies configured to be selectively coupled to the power connector, the first and second plug assemblies having first and second mating interfaces both configured to mate with the plug interface of the power connector, wherein the first plug assembly includes a line cord having a pump plug at one end of the line cord and an outlet plug at an opposite end of the line cord, and wherein the second plug assembly includes a conduit box having plug contacts configured to be field wired to a power cable within the conduit box;

wherein the conduit box includes a mounting end configured to be mounted to the control module, the mounting end being curved to match a curvature of the contact module such that the mounting end of the conduit box rests flush against the control module, a gasket being provided between the mounting end and the control module to seal the conduit box against the control module.

23. The pump assembly of claim 22, wherein the first and second plug assemblies are removably coupled to the power connector.

24. The pump assembly of claim 22, wherein the first and second mating interfaces are substantially identical to one another, the first plug assembly removably coupled to the power connector such that a separable interface is defined between the plug interface and the first mating interface, the second plug being removably coupled to the power connector such that a separable interface is defined between the plug interface and the second mating interface.

25. The pump assembly of claim 22, wherein the power connector includes a boss extending outward therefrom, the boss defining a portion of the plug interface, the boss having a cavity configured to selectively receive the first plug assembly or the second plug assembly, the boss having a keying feature to orient the first plug assembly or the second plug assembly with respect to the power connector.

26. The pump assembly of claim 22, wherein the conduit box includes a wiring chamber and a connector chamber, the second plug assembly further includes a contact subassembly being positioned in the connector chamber for mating with the power contacts, wherein the wiring chamber is configured to receive the power cable for field wiring individual wires of the power cable to the contact subassembly.

27. The pump assembly of claim 22, wherein the control module includes a circuit board and a display mounted to the circuit board, the power contacts being terminated to the circuit board, wherein the first plug assembly is configured to be selectively coupled to the power connector to provide power to the circuit board for the display, and wherein the second plug assembly is configured to be selectively coupled to the power connector to provide power to the circuit board for the display.

* * * * *